US008393402B2

(12) United States Patent
Saurer

(10) Patent No.: US 8,393,402 B2
(45) Date of Patent: Mar. 12, 2013

(54) REDUNDANT POSITION REFERENCE SYSTEM FOR MULTILATERAL EXIT CONSTRUCTION AND METHOD FOR USE OF SAME

(75) Inventor: Dan Saurer, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 203 days.

(21) Appl. No.: 12/917,070

(22) Filed: Nov. 1, 2010

(65) Prior Publication Data

US 2012/0103687 A1 May 3, 2012

(51) Int. Cl.
*E21B 7/08* (2006.01)

(52) U.S. Cl. ..... 166/382; 166/117.6; 166/255.3

(58) Field of Classification Search ..... 175/45, 175/75, 81; 166/117.5, 117.6, 255.3, 382
See application file for complete search history.

(56) References Cited

U.S. PATENT DOCUMENTS 5,388,648 A * 2/1995 Jordan, Jr. ..... 166/380
5,564,503 A * 10/1996 Longbottom et al. ..... 166/313
5,579,829 A 12/1996 Comeau et al.
5,615,740 A 4/1997 Comeau et al.
5,735,350 A * 4/1998 Longbottom et al. ..... 166/313
5,871,046 A 2/1999 Robison
6,012,527 A * 1/2000 Nitis et al. ..... 166/313
6,070,667 A 6/2000 Gano
6,202,746 B1 3/2001 Vandenberg et al.
6,935,428 B2 8/2005 McGlothen et al.

OTHER PUBLICATIONS

International Search Report and Written Opinion, PCT/US2011/057603, KIPO, Apr. 27, 2012.

* cited by examiner

*Primary Examiner* — Jennifer H Gay
*Assistant Examiner* — Blake Michener
(74) *Attorney, Agent, or Firm* — Lawrence R. Youst

(57) ABSTRACT

A position reference system (100) for multilateral exit construction in a wellbore (32). The system (100) includes a casing string (34) having a window joint (106) and a pair of latch couplings (102, 104) interconnected therein and positioned in the wellbore (32). The first latch coupling (102) has a first inner profile operably engagable with a mating profile of a first latch assembly (114) to anchor and orient the first latch assembly (114) relative to the window joint (106). The second latch coupling (104) has a second inner profile that is different from the first inner profile of the first latch coupling (102). The second inner profile is operably engagable with a mating profile of a second latch assembly (124) to anchor and orient the second latch assembly (124) relative to the window joint (106).

17 Claims, 6 Drawing Sheets

28
10
26
12
20
18
22
24
16
30
32
34
36
42
40
44
38
14

REDUNDANT POSITION REFERENCE SYSTEM FOR MULTILATERAL EXIT CONSTRUCTION AND METHOD FOR USE OF SAME

TECHNICAL FIELD OF THE INVENTION

This invention relates, in general, to equipment utilized in conjunction with operations performed in subterranean wells and, in particular, to a redundant position reference system for multilateral exit construction and a method for use of same.

BACKGROUND OF THE INVENTION

Without limiting the scope of the present invention, its background will be described in relation to forming a window in a casing string for a multilateral well, as an example.

In multilateral wells it is common practice to drill a branch or lateral wellbore extending laterally from an intersection with a main or parent wellbore. Typically, once the casing string is installed and the parent wellbore has been completed, a whipstock is positioned in the casing string at the desired intersection and then one or more mills are deflected laterally off of the whipstock to form a window through the casing sidewall.

In certain installations, it is desirable to drill the lateral wellbore in a predetermined direction from the parent wellbore such as out of the high side of the parent wellbore. In such installations, it is necessary to form the window at a predetermined circumferential orientation relative to the parent casing. In order to properly position and rotationally orient the whipstock such that the window is milled in the desired direction, a latch assembly associated with the whipstock is anchored into and rotationally oriented within a latch coupling interconnected in the casing string. The latch assembly typically includes a plurality of spring operated keys, each of which have an anchoring and orienting profile that is received in a mating profile formed internally within the latch coupling. In this manner, when the latch assembly is operatively engaged with the internal profile of the latch coupling, the latch assembly and the equipment associate therewith may be anchored and rotationally oriented in the desired direction within the casing string.

It has been found, however, that operative engagement of the latch assembly with the latch coupling sometimes fails. For example, a latch coupling may be damaged during completion of the parent wellbore. Alternatively or additionally, drilling fluid solids or other debris may obstruct portions of the internal profile of the latch coupling such that it fails to properly interact with the latch assembly. In such situations, numerous additional trips into the well may be required to perform remedial action including, for example, installation of a new position reference device that is suspending within the casing via a packer assembly.

Accordingly, a need has arisen for improved system for constructing an exit for a multilateral well that does not require numerous additional trips into the well in the event of a latch coupling failure. In addition, a need has arisen for such an improved system that does not require remedial action to be performed in the event of a latch coupling failure. Further, a need has arisen for such an improved system that does not require installation of a new position reference device in the casing string in the event of a latch coupling failure.

SUMMARY OF THE INVENTION

The present invention disclosed herein is directed to a redundant position reference system for multilateral exit construction. In the event of a latch coupling failure, the redundant position reference system of the present invention does not require numerous additional trips into the well to perform remedial action or the installation of a new position reference device in the casing string.

In one aspect, the present invention is directed to a position reference system for multilateral exit construction in a wellbore. The system includes a casing string positioned in the wellbore. A window joint is interconnected in the casing string. A first latch coupling is interconnected in the casing string downhole of the window joint. A second latch coupling is interconnected in the casing string downhole of the first latch coupling. The first latch coupling has a first inner profile operably engagable with a mating profile of a first latch assembly to anchor and orient the first latch assembly relative to the window joint. The second latch coupling has a second inner profile that is different from the first inner profile. The second inner profile is operably engagable with a mating profile of a second latch assembly to anchor and orient the second latch assembly relative to the window joint.

In one embodiment, the first latch coupling is positioned proximate the window joint in the casing string. In another embodiment, the second latch coupling is positioned proximate the first latch coupling in the casing string. In certain embodiments, the first inner profile of the first latch coupling may include one or more of a plurality of axially spaced apart recessed grooves, a plurality of circumferentially extending recessed grooves, a plurality of circumferentially extending recessed grooves that extend about the entire circumference of the first latch coupling, at least one preferential circumferential alignment element and a plurality of preferential circumferential alignment elements. Likewise, the second inner profile of the second latch coupling may include one or more of a plurality of axially spaced apart recessed grooves, a plurality of circumferentially extending recessed grooves, a plurality of circumferentially extending recessed grooves that extend about the entire circumference of the second latch coupling, at least one preferential circumferential alignment element and a plurality of preferential circumferential alignment elements.

In another aspect, the present invention is directed to a position reference method for multilateral exit construction in a wellbore. The method includes positioning a casing string in the wellbore, the casing string including a window joint, a first latch coupling downhole of the window joint and a second latch coupling downhole of the first latch coupling, the first latch coupling having a first inner profile that is different from a second inner profile of the second latch coupling; running a whipstock assembly having a deflector surface and a latch assembly into the casing string; and operatively engaging an outer profile of the latch assembly with the first inner profile, thereby anchoring the whipstock assembly and orienting the deflector surface relative to the window joint.

The method may also include operatively engaging a plurality of keys with a plurality of axially spaced apart, circumferentially extending recessed grooves and operatively engaging the plurality of keys with a plurality of preferential circumferential alignment elements.

In a further aspect, the present invention is directed to a position reference method for multilateral exit construction in a wellbore. The method includes positioning a casing string in the wellbore, the casing string including a window joint, a first latch coupling downhole of the window joint and a second latch coupling downhole of the first latch coupling; running a first whipstock assembly having a first latch assembly into the casing string; failing to operatively engage an outer profile of the first latch assembly with an inner profile of the first latch coupling; retrieving the first whipstock assembly to the surface; running a second whipstock assembly having a second latch assembly into the casing string; passing the second latch assembly through the first latch coupling; and operatively engaging an outer profile of the second latch assembly with an inner profile of the second latch coupling, thereby anchoring and orienting the second whipstock assembly relative to the window joint.

The method may also include operatively engaging a plurality of keys with a plurality of axially spaced apart, circumferentially extending recessed grooves, operatively engaging the plurality of keys with a plurality of preferential circumferential alignment elements and spacing out the second whipstock assembly with an extension joint.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
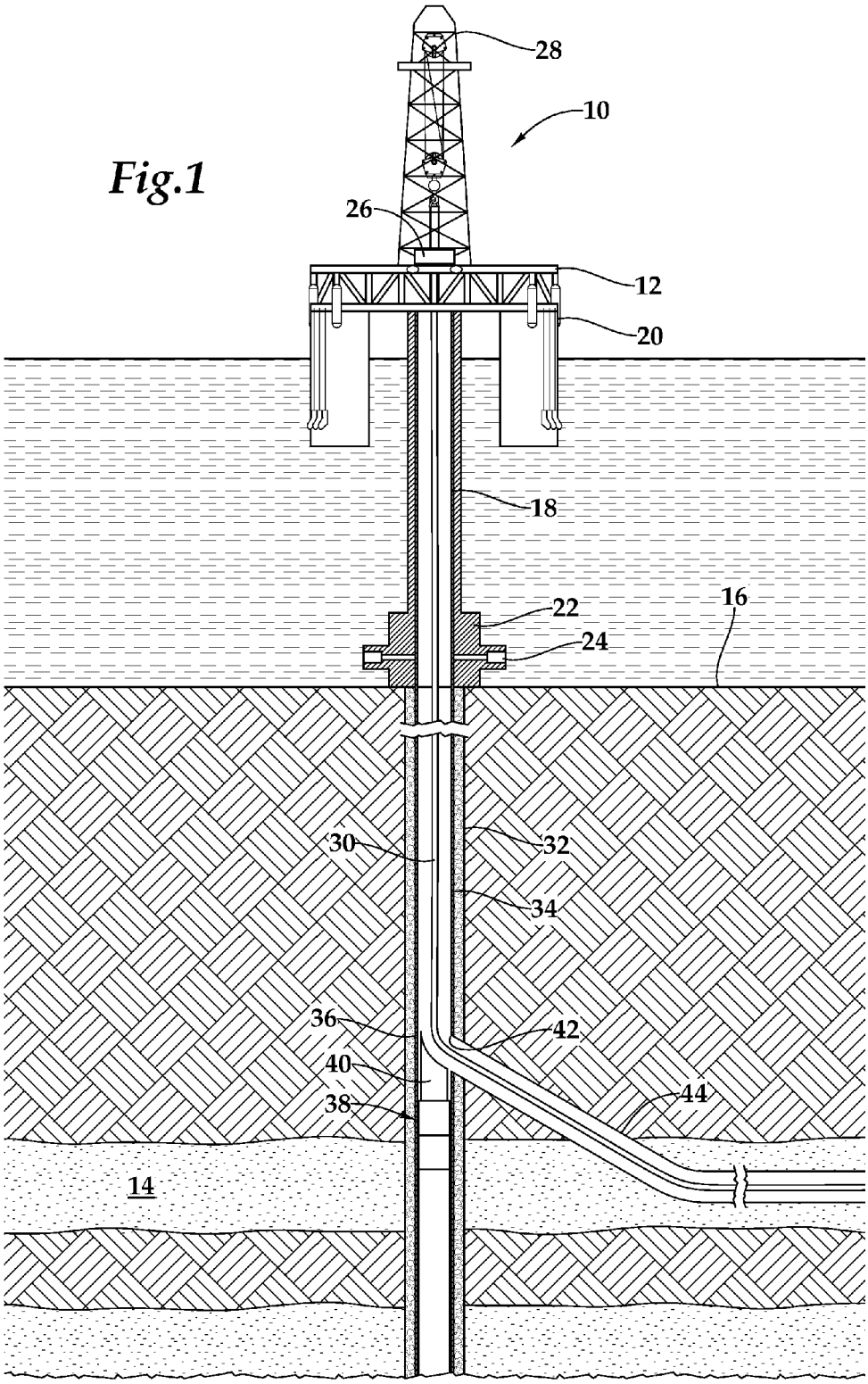
FIG. 1 is a schematic illustration of an offshore platform operating a redundant position reference system for multilateral exit construction according to an embodiment of the present invention.

Referring to FIG. 1, a redundant position reference system for multilateral exit construction in use with an offshore oil and gas platform is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings such as drill string 30. A main wellbore 32 has been drilled through the various earth strata including formation 14. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. A casing string 34 is cemented within main wellbore 32. The term "casing" is used herein to designate a tubular string used to line a wellbore. Casing may actually be of the type known to those skilled in the art as "liner" and may be made of any material, such as steel or composite material and may be segmented or continuous, such as coiled tubing.

The casing string 34 includes a window joint 36 interconnected therein. In addition, casing string 34 includes a redundant position reference system 38 that is depicted as a pair of latch couplings interconnected in casing string 34. Each latch coupling has a unique inner profile that is operably engagable with a unique outer profile of a latch assembly such that the appropriate latch assembly may be anchored and rotationally oriented within its designated latch coupling. For example, latch couplings and latch assemblies that may be suitable for use in the present invention are described in U.S. Pat. Nos. 5,579,829, and 5,615,740, both of which are hereby incorporated by reference for all purposes. Located within and extending upwardly from position reference system 38 is a whipstock 40 having a deflector surface that is positioned in a desired circumferential orientation relative to window joint 36 such that a window 42 can be milled, drilled or otherwise formed in window joint 36 in the desired circumferential direction. As illustrated, window joint 36 is positioned at a desired intersection between main wellbore 32 and a branch or lateral wellbore 44. The terms "branch" and "lateral" wellbore are used herein to designate a wellbore which is drilled outwardly from its intersection with another wellbore, such as a parent or main wellbore. A branch or lateral wellbore may have another branch or lateral wellbore drilled outwardly therefrom.

Even though FIG. 1 depicts the redundant position reference system for multilateral exit construction of the present invention in a vertical section of the main wellbore, it should be understood by those skilled in the art that the system of the present invention is equally well suited for use in wellbores having other directional configurations including horizontal wellbores, deviated wellbores, slanted wells, lateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
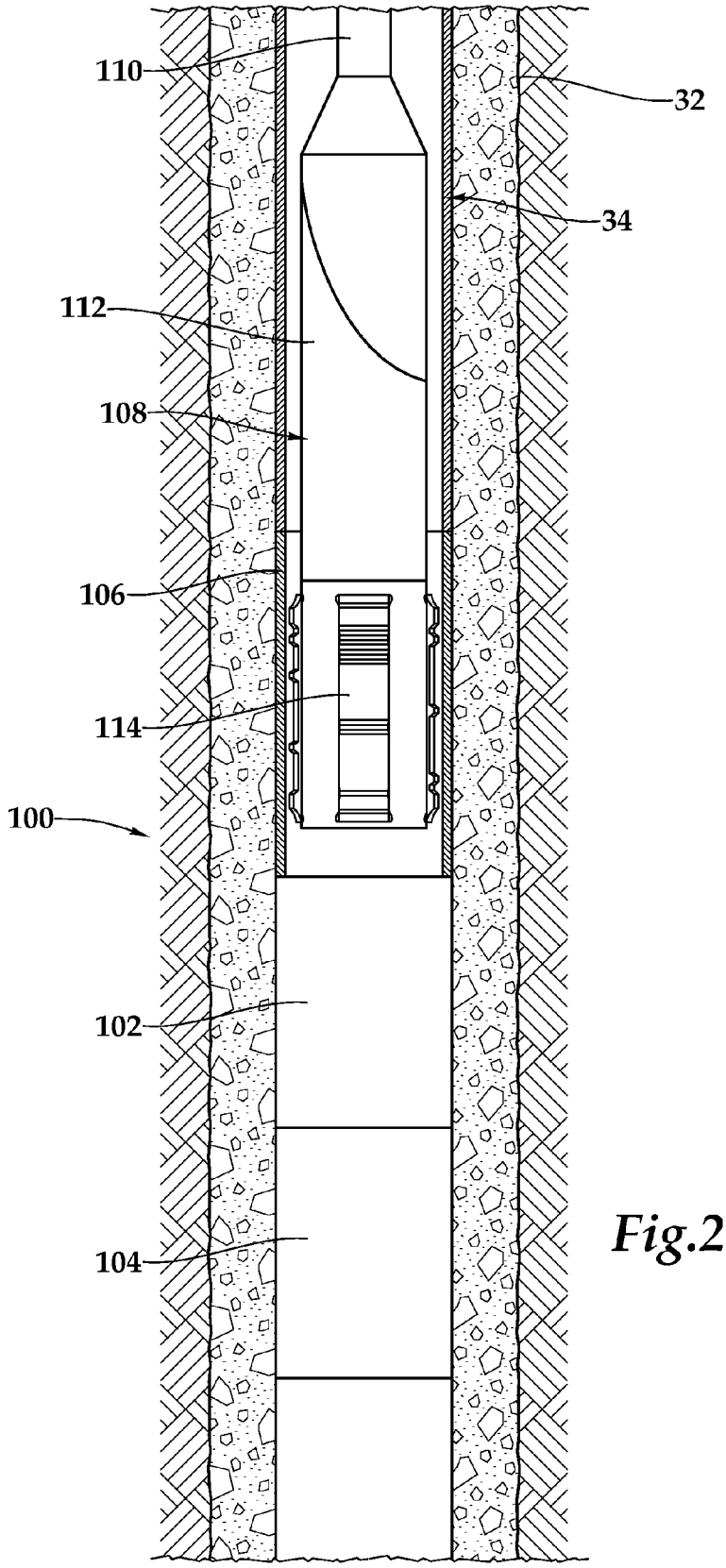
FIG. 2 is a schematic illustration of a redundant position reference system for multilateral exit construction according to an embodiment of the present invention in a first operational configuration.

Referring now to FIG. 2, a redundant position reference system for multilateral exit construction of the present invention is schematically depicted and generally designated 100. In the illustrated embodiment, redundant position reference system 100 is constructed as part of casing string 34 that has been cemented within wellbore 32. Redundant position reference system 100 includes a latch coupling 102 and a latch coupling 104 that are interconnected within casing string 34. In the illustrated embodiment, latch coupling 102 and latch coupling 104 are depicted as being interconnected within casing string 34 proximate one another, however, those skilled in the art will recognize that other tools or tubulars may alternatively be interconnected within casing string 34 between latch coupling 102 and latch coupling 104. As explained in further detail below, each of latch coupling 102 and latch coupling 104 preferably has a unique profile including a plurality of preferential circumferential alignment elements that is operable to receive a latch assembly therein and locate the latch assembly in a particular circumferential orientation and axial position. As each of latch coupling 102 and latch coupling 104 has a unique profile, the required spacing between latch coupling 102 and latch coupling 104 can be minimized, as depicted in FIG. 2, as there will be no uncertainty regarding which latch coupling a particular latch assembly engages with.

In the illustrated embodiment, casing string 34 includes a window joint 106 that is preferably formed from an easily millable or drillable material such as aluminum. Even though latch coupling 102 and window joint 106 are depicted as being interconnected within casing string 34 proximate one another, those skilled in the art will recognize that other tools or tubulars may alternatively be interconnected within casing string 34 between latch coupling 102 and window joint 106. Also, even though window joint 106 has been described as being formed from an easily millable or drillable material, those skilled in the art will understand that window joint 106 could alternatively be formed from standard casing or could have a pre-milled window formed therein.

Figure 4:
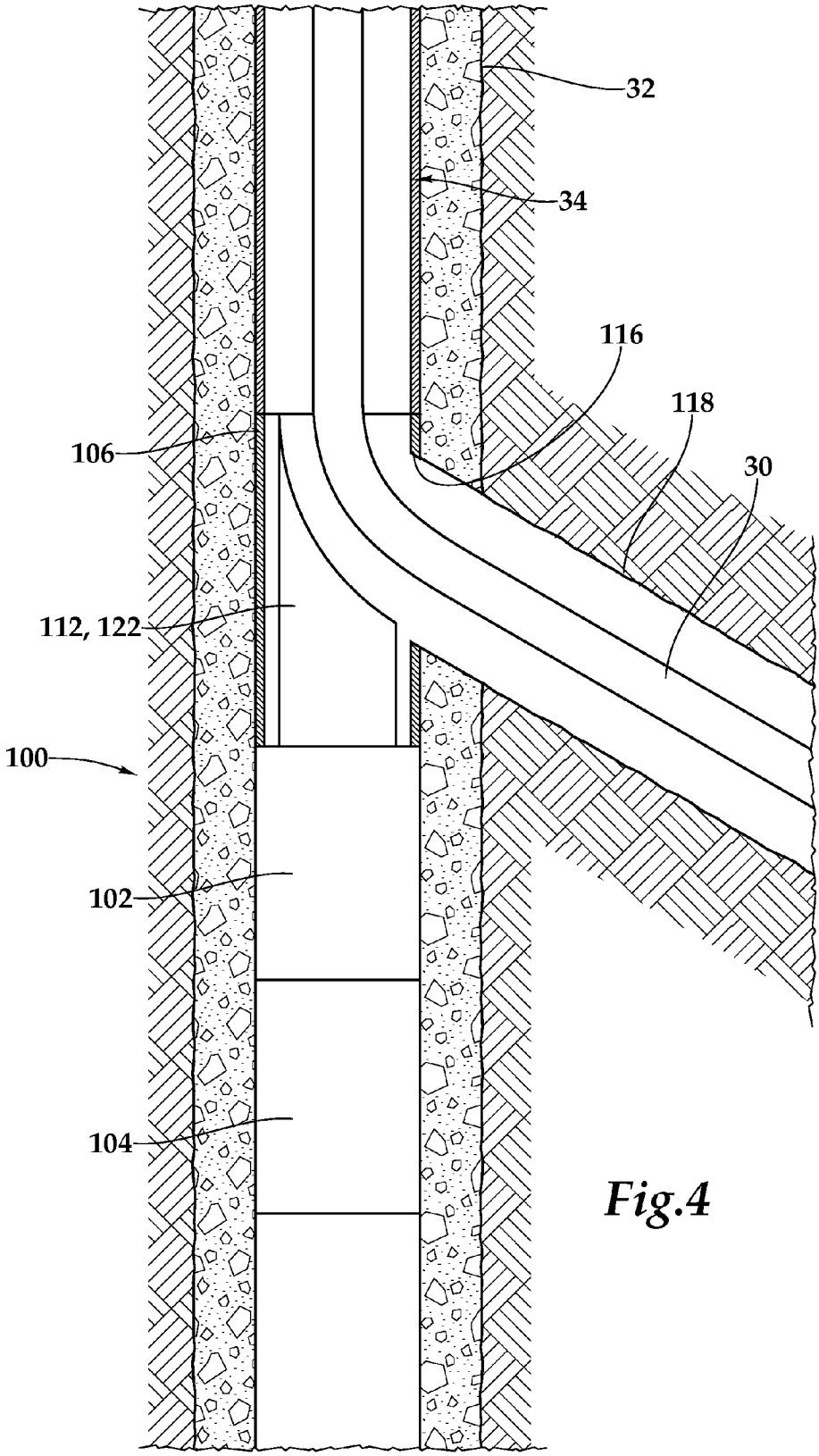
FIG. 4 is a schematic illustration of a redundant position reference system for multilateral exit construction according to an embodiment of the present invention after a window has been milled out of the casing string.

Disposed within casing string 34 is a whipstock assembly 108 that has been run into casing string 34 on a conveyance 110 such as jointed tubing, coiled tubing or the like. In the illustrated embodiment, whipstock assembly 108 includes a deflector assembly 112 having a deflector surface operable to direct a milling or drilling tool into the sidewall of window joint 106 to create a window therethrough. Whipstock assembly 108 also includes a latch assembly 114 having a unique outer profile that is operable to engage with the unique inner profile and preferential circumferential alignment elements of latch coupling 102. In operation, when latch assembly 114 operably engages with latch coupling 102, whipstock assembly 108 will be located within casing string 34 such that the deflector surface of deflector assembly 112 is positioned in a desired axial location and circumferential orientation relative to window joint 106. This enables the deflector surface of whipstock assembly 108 to direct the milling and drilling tools to the right to form window 116 and branch wellbore 118, as representatively illustrated in FIG. 4.

If for some reason, latch assembly 114 is not able to operably engage with latch coupling 102, the present invention provides a redundant system that does not require numerous additional trips into the well to perform remedial action such as the installation of a new position reference device in casing string 34. If it is determined that latch coupling 102 is unable to receive latch assembly 114, whipstock assembly 108 may be retrieved to the surface via conveyance 110 and an alternate whipstock assembly may be run downhole into casing string 34 that includes a latch assembly that is operable to engage with latch coupling 104.

Figure 3:
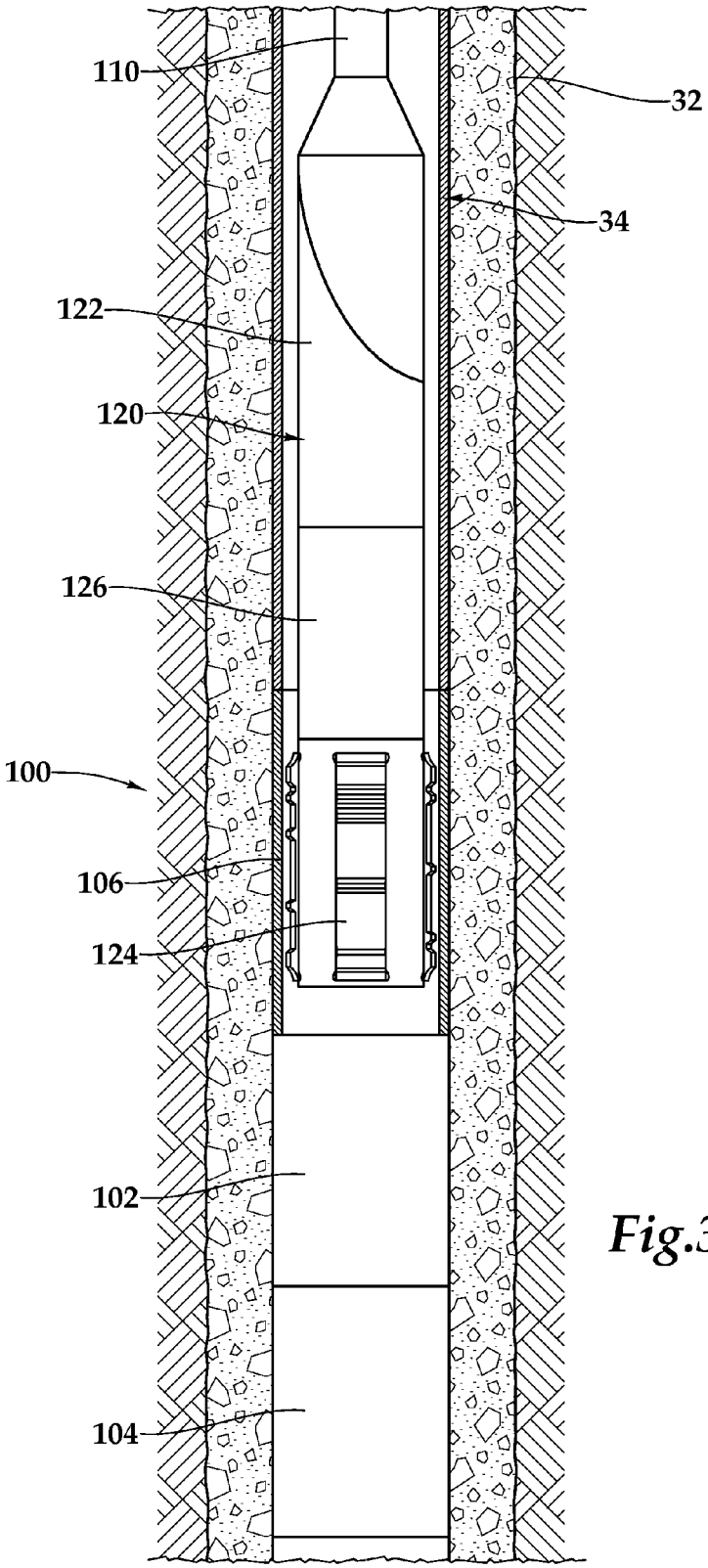
FIG. 3 is a schematic illustration of a redundant position reference system for multilateral exit construction according to an embodiment of the present invention in a second operational configuration.

Referring next to FIG. 3, the redundant position reference system 100 of the present invention is depicted in this alternate configuration. As illustrated, redundant position reference system 100 includes latch coupling 102 and latch coupling 104 interconnected within casing string 34 below window joint 106. Disposed within casing string 34 is a whipstock assembly 120 that has been run into casing string 34 on a conveyance 110. Whipstock assembly 120 includes a deflector assembly 122 having a deflector surface operable to direct a milling or drilling tool into the sidewall of window joint 106 to create a window therethrough. Whipstock assembly 120 also includes a latch assembly 124 having a unique outer profile that is operable to engage with the unique inner profile and preferential circumferential alignment elements of latch coupling 104. In addition, whipstock assembly 120 includes an extension joint 126 positioned between deflector assembly 122 and latch assembly 124. Extension joint 126 is included within whipstock assembly 120 to provide proper space out between deflector assembly 122 and latch assembly 124.

In operation, as whipstock assembly 120 is lowered into casing string 34, latch assembly 124 is operable to pass through latch coupling 102 as the unique outer profile of latch assembly 124 does not engage with the unique inner profile and preferential circumferential alignment elements of latch coupling 102. Instead, the unique outer profile of latch assembly 124 is designed to engage with the unique inner profile and preferential circumferential alignment elements of latch coupling 104. Accordingly, when latch assembly 124 operably engages with latch coupling 104 and due to the space out enabled by extension joint 126, whipstock assembly 120 will be located within casing string 34 such that the deflector surface of deflector assembly 122 is positioned in the desired axial location and circumferential orientation relative to window joint 106. This enables the deflector surface of whipstock assembly 120 to direct the milling and drilling tools to the right to form window 116 and branch wellbore 118, as representatively illustrated in FIG. 4.

Figure 5:
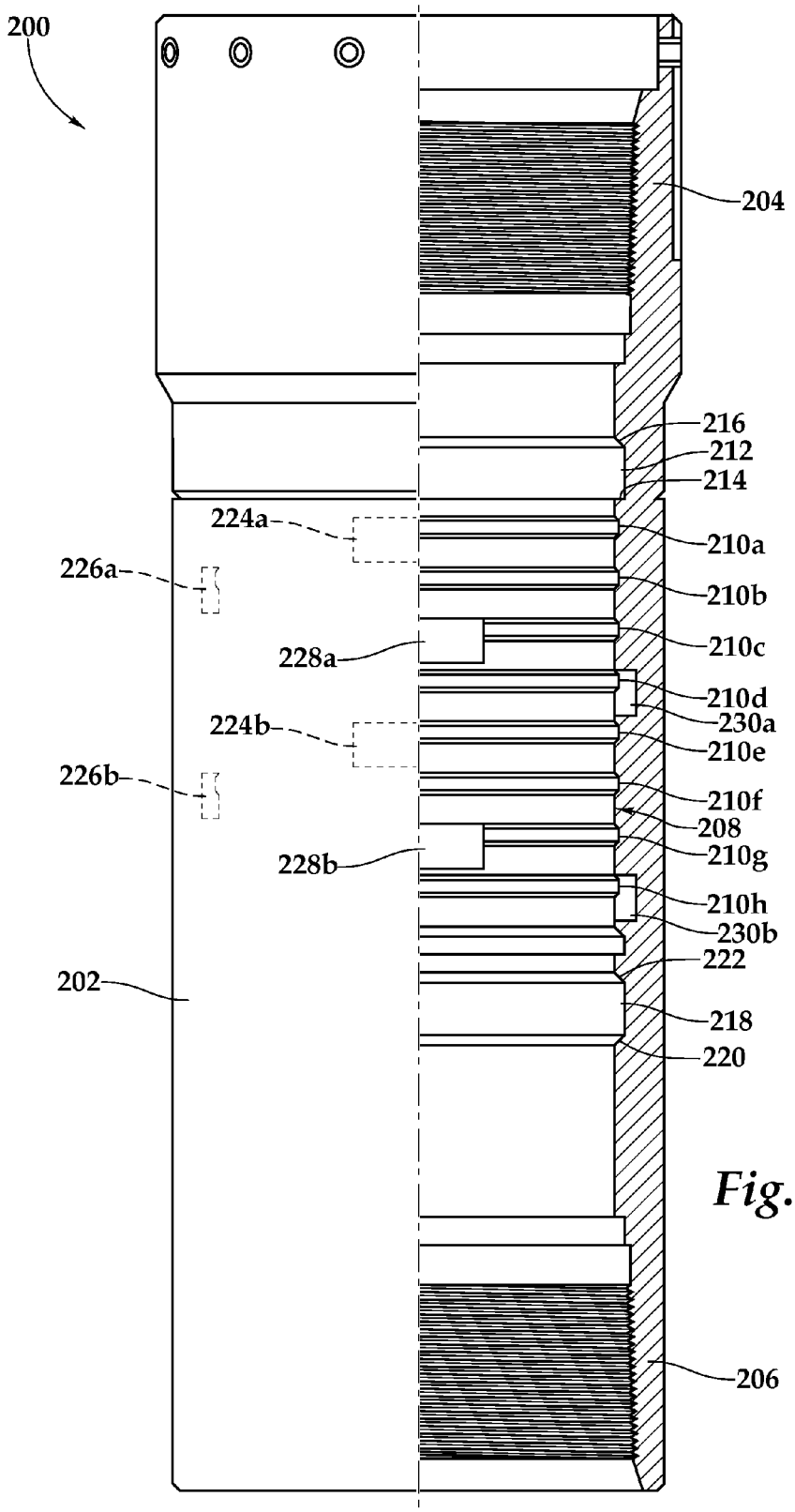
FIG. 5 is a quarter sectional view of a latch coupling of a redundant position reference system for multilateral exit construction according to an embodiment of the present invention.

Referring next to FIG. 5, one embodiment of a latch coupling for the redundant position reference system of the present invention is depicted and generally designated 200. Latch coupling 200 is representative of latch coupling 102 and latch coupling 104 depicted above; however, as discussed above, latch coupling 102 and latch coupling 104 have unique inner profile and preferential circumferential alignment elements that are different from one another to enable selective engagement with a matching or mating outer profile of the desired latch assembly. Accordingly, latch coupling 200 is described herein to illustrate the type of elements and combination of elements that can be used to create any number of unique profiles as contemplated by the present invention.

Latch coupling 200 has a generally tubular body 202 and may be coupled to other tools or tubulars of casing string 34 via threaded connections 204, 206. Latch coupling 200 includes an internal profile 208 including a plurality of axially spaced apart recessed grooves 210*a*-210*h* that extend circumferentially about the inner surface of latch coupling 200. Preferably, recessed grooves 210*a*-210*h* extend about the entire circumferential internal surface of latch coupling 200. Internal profile 208 also includes an upper groove 212 having a lower square shoulder 214 and an upper angled shoulder 216. Internal profile 208 further includes a lower groove 218 having a lower angled shoulder 220 and an upper angled shoulder 222.

Internal profile 208 also has a plurality of preferential circumferential alignment elements depicted as a plurality of slots disposed within the inner surface of latch coupling 200. In the illustrated embodiment, there are four sets of two slots that are disposed in different axial and circumferential positions or locations within the inner surface of latch coupling 200. For example, a first set of two slots or recesses 224*a*, 224*b* (collectively recesses 224) are disposed within the inner surface of latch coupling 200 at substantially the same circumferential positions and different axial positions. A second set of two slots or recesses 226*a*, 226*b* (collectively recesses 226) are disposed within the inner surface of latch coupling 200 at substantially the same circumferential positions and different axial positions. A third set of two slots or recesses 228*a*, 228*b* (collectively recesses 228) are disposed within the inner surface of latch coupling 200 at substantially the same circumferential positions and different axial positions. A fourth set of two slots or recesses 230*a*, 230*b* (collectively recesses 230) are disposed within the inner surface of latch coupling 200 at substantially the same circumferential positions and different axial positions.

As shown, recesses 226 are disposed within the inner surface of latch coupling 200 at a ninety degree angle circumferentially from recesses 224. Likewise, recesses 228 are disposed within the inner surface of latch coupling 200 at a ninety degree angle circumferentially from recesses 226. Finally, recesses 230 are disposed within the inner surface of latch coupling 200 at a ninety degree angle circumferentially from recesses 228. Preferably, recesses 224, 226, 228, 230 only partially extend circumferentially about the internal surface of latch coupling 200.

Profile 208 including the preferential circumferential alignment elements creates a unique mating pattern operable to cooperate with an external key profile associated with a desired latch assembly to axially and circumferentially anchor and orient a whipstock assembly in a particular desired circumferential orientation relative to the latch coupling. The specific profile of each latch coupling can be created by varying one or more of the elements or parameters thereof. For example, the thickness, number and relative spacing of the recessed grooves can be altered, the axial and circumferential spacing of the preferential circumferential alignment elements can be altered, the axial and circumferential thickness of the preferential circumferential alignment elements can be altered, the number of preferential circumferential alignment elements can be altered and the like.

Figure 6A:
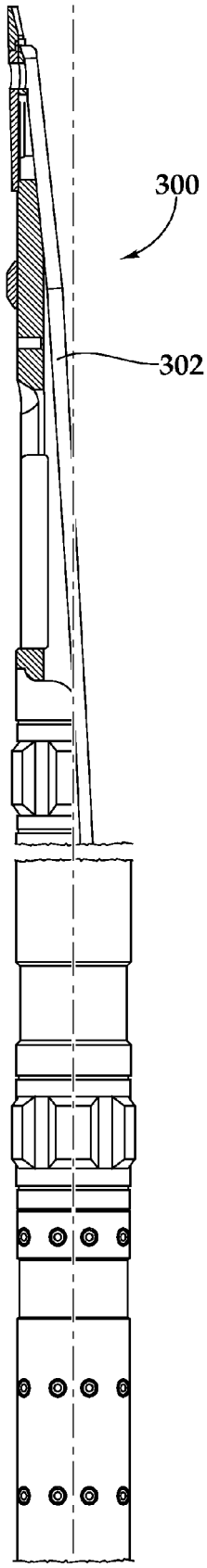
FIGS. 6A-6B are side views of a whipstock assembly operable for use with a redundant position reference system for multilateral exit construction according to an embodiment of the present invention.
Figure 6B:
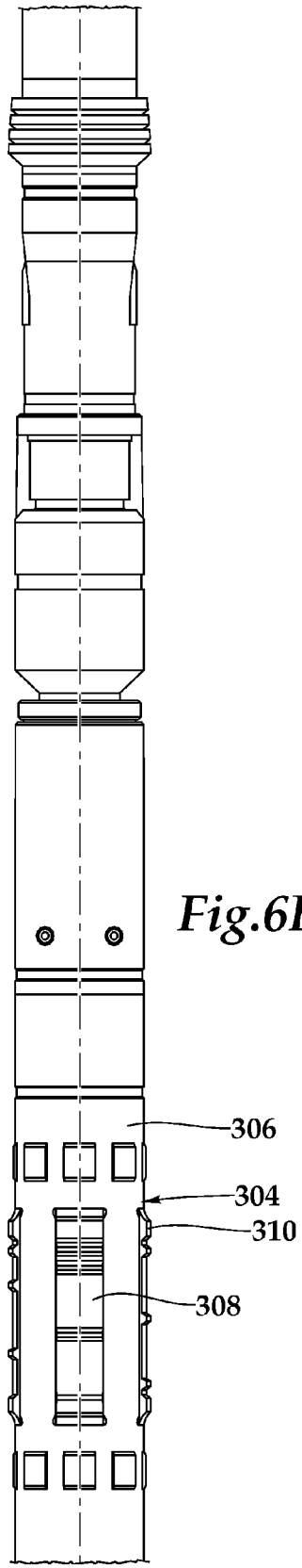

Referring next to FIGS. 6A-6B, a whipstock assembly operable for use with the redundant position reference system of the present invention is depicted and generally designated 300. Whipstock assembly 300 includes a whipstock face 302 disposed substantially at the upper end of whipstock assembly 300. Whipstock face 302 is tapered from its upper end to its lower end to provide a deflector surface operable to direct a milling or drilling assembly to form a window in the desired circumferential orientation in the window joint of the casing string.

In the illustrated embodiment, whipstock assembly 300 includes a latch assembly 304. Latch assembly 304 includes a latch housing 306 having a plurality of elongated openings formed through a sidewall thereof. A plurality of spring operated keys 308 extend through the elongated openings. Keys 308 are radially outwardly biased by Belleville springs that urge conical wedges under keys 308 from above and below. Alignment between keys 308 and the openings as well as appropriate spacing between keys 308 are maintained by latch housing 306, which also limits the outward displacement keys 308.

As described above, the anchoring and orienting functions of latch assembly 304 with a latch coupling having the appropriate mating profile are achieved may mechanical manipulation to provide both circumferential and axial positioning by engagement between external profiles 310 formed on each of the keys 302 and inner profile and preferential circumferential alignment elements formed in the latch coupling. Different profiles 310 are formed on keys 308 of latch assembly 304, to correspond to different radial portions of the inner profile and preferential circumferential alignment elements formed in the latch coupling. When latch assembly 304 is disposed within the corresponding latch coupling, profiles 310 on keys 308 initially engage the inner profile and thereby prevent further axial displacement of latch assembly 304 relative to the latch coupling. Latch assembly 304 is then rotated within the latch coupling, until each of the profiles 310 engages the corresponding preferential circumferential alignment elements formed in the latch coupling, thereby preventing further rotational displacement of latch assembly 304 relative to the latch coupling.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A redundant position reference system for multilateral exit construction in a wellbore, the system comprising:

a casing string positioned in the wellbore;

a window joint interconnected in the casing string;

a first latch coupling interconnected in the casing string downhole of the window joint, the first latch coupling having a first inner profile;

a first whipstock assembly operable to be run in the casing string, the first whipstock assembly including a first latch assembly having a first mating profile operably engagable with the first inner profile to anchor and orient the first latch assembly within the first latch coupling and to axially locate and circumferentially orient a first deflector surface of the first whipstock assembly within the window joint;

a second latch coupling interconnected in the casing string downhole of the first latch coupling, the second latch coupling having a second inner profile that is different from the first inner profile; and a second whipstock assembly operable to be run in the casing string, the second whipstock assembly including a second latch assembly having a second mating profile operable to pass through the first inner profile and operably engagable with the second inner profile to anchor and orient the second latch assembly within the second latch coupling and to axially locate and circumferentially orient a second deflector surface of the second whipstock assembly within the window joint, thereby providing redundant access to the window joint.

2. The position reference system as recited in claim 1 wherein the first latch coupling is positioned proximate the window joint in the casing string.

3. The position reference system as recited in claim 1 wherein the second latch coupling is positioned proximate the first latch coupling in the casing string.

4. The position reference system as recited in claim 1 wherein the first inner profile of the first latch coupling further comprises a plurality of axially spaced apart recessed grooves.

5. The position reference system as recited in claim 1 wherein the first inner profile of the first latch coupling further comprises a plurality of circumferentially extending recessed grooves.

6. The position reference system as recited in claim 1 wherein the first inner profile of the first latch coupling further comprises a plurality of circumferentially extending recessed grooves that extend about the entire circumference of the first latch coupling.

7. The position reference system as recited in claim 1 wherein the first inner profile of the first latch coupling further comprises at least one circumferential alignment element.

8. The position reference system as recited in claim 1 wherein the first inner profile of the first latch coupling further comprises a plurality of circumferential alignment elements.

9. The position reference system as recited in claim 1 wherein the second inner profile of the second latch coupling further comprises a plurality of axially spaced apart recessed grooves.

10. The position reference system as recited in claim 1 wherein the second inner profile of the second latch coupling further comprises a plurality of circumferentially extending recessed grooves.

11. The position reference system as recited in claim 1 wherein the second inner profile of the second latch coupling further comprises a plurality of circumferentially extending recessed grooves that extend about the entire circumference of the second latch coupling.

12. The position reference system as recited in claim 1 wherein the second inner profile of the second latch coupling further comprises at least one circumferential alignment element.

13. The position reference system as recited in claim 1 wherein the second inner profile of the second latch coupling further comprises a plurality of circumferential alignment elements.

14. A redundant position reference method for multilateral exit construction in a wellbore, the method comprising:

positioning a casing string in the wellbore, the casing string including a window joint, a first latch coupling downhole of the window joint and a second latch coupling downhole of the first latch coupling, the first latch coupling having a first inner profile, the second latch coupling having a second inner profile that is different from the first inner profile;

running a first whipstock assembly having a first latch assembly into the casing string, the first latch assembly having a first mating profile operably engagable with the first inner profile such that operable engagement of the first mating profile with the first inner profile anchors and orients the first latch assembly within the first latch coupling to axially locate and circumferentially orient a first deflector surface of the first whipstock assembly within the window joint;

failing to operatively engage the first mating profile of the first latch assembly with the first inner profile of the first latch coupling;

retrieving the first whipstock assembly to the surface;

running a second whipstock assembly having a second latch assembly into the casing string, the second latch assembly having a second mating profile operably engagable with the second inner profile;

passing the second latch assembly through the first latch coupling; and operatively engaging the second mating profile of the second latch assembly with the inner profile of the second latch coupling, to anchor and orient the second latch assembly within the second latch coupling and to axially locate and circumferentially orient a second deflector surface of the second whipstock assembly within the window joint, thereby providing redundant access to the window joint.

15. The method as recited in claim 14 wherein operatively engaging the second mating profile of the second latch assembly with the inner profile of the second latch coupling further comprises operatively engaging a plurality of keys with a plurality of axially spaced apart, circumferentially extending recessed grooves.

16. The method as recited in claim 15 wherein operatively engaging the second mating profile of the second latch assembly with the inner profile of the second latch coupling profile further comprises operatively engaging the plurality of keys with a plurality of circumferential alignment elements.

17. The method as recited in claim 14 wherein running a second whipstock assembly having a second latch assembly into the casing string further comprising spacing out the second whipstock assembly with an extension joint.

* * * * *